United States Patent [19]

Bartolo et al.

[11] Patent Number: 4,714,907

[45] Date of Patent: Dec. 22, 1987

[54] MINIATURE ELECTRICAL CIRCUIT BREAKER WITH MULTIPLE MOVING CONTACTS AND THERMOMAGNETIC TRIP RELEASE

[75] Inventors: William Bartolo, Eybens; Louis Boillot, Grenoble; René Challande, Montmelian; Patrick De Robertis, Vizille; Jacky Duchenaud, Grenoble; Jean-Claude Ramaciotti, Echirolles, all of France

[73] Assignee: Merlin Gerin, Grenoble Cedex, France

[21] Appl. No.: 883,331

[22] Filed: Jul. 8, 1986

[30] Foreign Application Priority Data

Jul. 31, 1985 [FR] France ..... 85 11839
Jan. 3, 1986 [FR] France ..... 86 00111

[51] Int. Cl.[4] ..... H01H 75/08; H01H 77/04; H01H 81/02

[52] U.S. Cl. ..... 335/45; 335/31; 335/35

[58] Field of Search ..... 335/31, 35, 43, 45, 335/160

[56] References Cited

U.S. PATENT DOCUMENTS 3,826,951 7/1974 Mater et al. ..... 335/160
4,166,993 9/1979 Krasser ..... 335/45
4,617,540 10/1986 Westermeyer ..... 335/35

FOREIGN PATENT DOCUMENTS 0007283 1/1980 European Pat. Off. .
597445 7/1928 Fed. Rep. of Germany .
1463684 11/1964 Fed. Rep. of Germany .
2262396 2/1975 France .
2344949 3/1976 France .
1162177 11/1966 United Kingdom ..... 335/43

*Primary Examiner*—E. A. Goldberg
*Assistant Examiner*—Lincoln Donovan
*Attorney, Agent, or Firm*—Parkhurst & Oliff

[57] ABSTRACT

The invention relates to a multiple moving contact assembly for a miniature circuit breaker with high ratings and a thermomagnetic trip release. The moving contact part of the circuit breaker includes two independent contact arms connected in parallel and mounted on a transverse spindle of the cradle. The arms are connected to a magnetic circuit of the electromagnetic trip release by two braids situated in symmetrical lateral areas. The contact parts bear on a single stationary contact pad so as to create two contact points enabling the temperature rise to be reduced. The electromagnetic top release has a coil including a tail arranged as an adjustable support device of a bimetallic strip, through whose foot the current flows thicknesswise. The tail is provided with a hinge between the junction point of the bimetallic strip and the coil, so as to allow relative movement of part of the tail due to the action of the thermal tripping threshold setting screw, the other part connected to the coil remaining appreciably station.

13 Claims, 10 Drawing Figures

MINIATURE ELECTRICAL CIRCUIT BREAKER WITH MULTIPLE MOVING CONTACTS AND THERMOMAGNETIC TRIP RELEASE

BACKGROUND OF THE INVENTION

The invention relates to a low voltage miniature electric circuit breaker equipped with a mechanism controlled by a thermomagnetic trip release, associated with an opening mechanism of a molded insulated case miniature circuit breaker, comprising:

a first thermal trip release with a bimetallic strip sensitive to overload currents, a second electromagnetic trip release for protection against short-circuit currents, comprising a control coil electromagnet, made up by helical winding of a deformable conductor having a preset rigidity, and an adjustment device of the thermal tripping threshold of the first trip release.

When the bimetallic strip and the electromagnet are located on the same side in relation to the position of the moving contact, one of the ends of the coil is connected to the head of the bimetallic strip by a connecting braid. Opposite the head, the foot of the bimetallic strip is generally supported by a metal support connected to an arc guiding electrode and to the pole contact pad. The braid connects the thermal trip release and the electromagnetic trip release in series. The metal support cooperates by deformation with a thermal tripping threshold adjusting screw, so as to cause a variation of the transverse clearance of the head of the bimetallic strip with the mechanism tripping bar. Heating of the bimetallic strip is direct, as the current flow takes place along its entire length. Industrial manufacture of a thermomagnetic trip release of this kind is complicated.

The object of the invention is to improve the setting adjustment of a thermomagnetic trip release for a high-rating miniature circuit breaker, and to reduce its dimensions and manufacturing cost.

SUMMARY OF THE INVENTION

The trip release according to the invention is characterized by the fact that the coil of said electromagnet is extended by a tail, arranged as an adjustable support part of the bimetallic strip, the foot of the latter being inserted by soldering between said tail and an electrical connection means with a contact pad, to cause the current to flow thickness-wise through the foot of the bimetallic strip, and that the tail comprises a hinge between the junction point of the foot of the bimetallic strip and the coil, in such a way as to allow relative movement of one part of said tail due to the action of the thermal tripping threshold adjustment device, the other part, connected to the coil, remaining appreciably stationary.

The use of the tail of the electromagnet coil as bimetallic strip support enables the connecting braid between the coil and the head of the bimetallic strip to be omitted, and no special support part of the foot of the bimetallic strip is required. In normal operation of the circuit breaker, the temperature rise of the coil due to the pole current flow can reach 90 degrees.

Soldering the foot of the bimetallic strip directly to the tail of the coil ensures a good heat transfer by conduction of the coil towards the bimetallic strip. The current flow thicknesswise across the foot of the bimetallic strip guarantees an excellent coherence between the pole current intensity and the thermal tripping threshold value.

The hinge is advantageously formed by an area of reduced crosssection allowing mechanical deformation of said tail, when a screw of said adjustment device is screwed in or out.

The presence of the hinge enables the tail of the coil to be deformed to adjust the thermal tripping threshold, without any stress being transmitted to the body of the electromagnet. This results in the electromagnetic tripping threshold of the second trip release remaining invariable when adjustment of the first trip release takes place.

The thermal tripping threshold is increased or decreased by screwing the adjusting screw in or out. The hinger articulation spindle comprises a needle or pivot cooperating with the reduced cross-sectional part of the tail.

The electrical connection means between the foot of the bimetallic strip and the corresponding contact pad may comprise a conducting lever extending in proximity to the bimetallic strip, in such a way as to constitute a combined device for indirect heating, by radiation of the bimetallic strip, and for transmission of the thermal threshold adjustment torque by the screw.

The circuit breaker comprises a plurality of identical independent contact arms mounted at regular intervals on a common transverse spindle articulated on a cradle of the mechanism, each moving contact arm comprising a contact part and a braid for electrical connection with the coil, said assembly having a symmetrical multiple structure with several branched elementary circuits, each one having a fraction of the pole rated current flowing through it resulting in the contact points with the satisfactory contact assembly being multiplied. The electromagnet extractor extends in the mid-plane of the casing to act simultaneously on all the independent contact arms when a short-circuit occurs, with the formation of several parallel elementary arcs at the beginning of opening travel of the contacts.

The moving contact assembly advantageously comprises two contact arms symmetrical in relation to the mid-plane and cooperating with a torsion spring threaded on a spindle inside said cradle, the spring being disposed in such a way as to provide an independent contact pressure on each contact arm in the closed position.

The moving contact assembly with twin independent contact arms enables:

the contact points to be multiplied and the temperature rise to be reduced;

good balancing of the moving assembly to be achieved due to the symmetrical structure of the multiple contact in relation to the mid-plane of the casing.

The two braids associated with the contact arms have a reduced cross-section, and are disposed in free lateral volumes symmetrical with respect to the mid-plane. The distribution of the current in the contact arms depends on the impedance of the two branched circuits. In the case of equal impedances, the pole current is divided by two in each contact arm. An impurity accidentally entering a contact area causes an automatic distribution of the current according to the impedances of the two branched circuits. The resulting temperature rise remains lower than if a single contact arm was used.

The contact arms leave the arc formation chamber simultaneously at the end of opening travel and retract behind the upper arcing horn puffing loop. Retraction of the moving contact assembly makes fitting of the preassembled stationary contact assembly easier.

BRIEF DESCRIPTION OF THE DRAWINGS

Other advantages and characteristics will become more clearly apparent from the following description of several embodiments of the invention, given as examples only and represented by the accompanying drawings, in which:

FIG. 2 is a sectional view according to the line II—II of

DESCRIPTION OF THE PREFERRED EMBODIMENT

Figure 1:
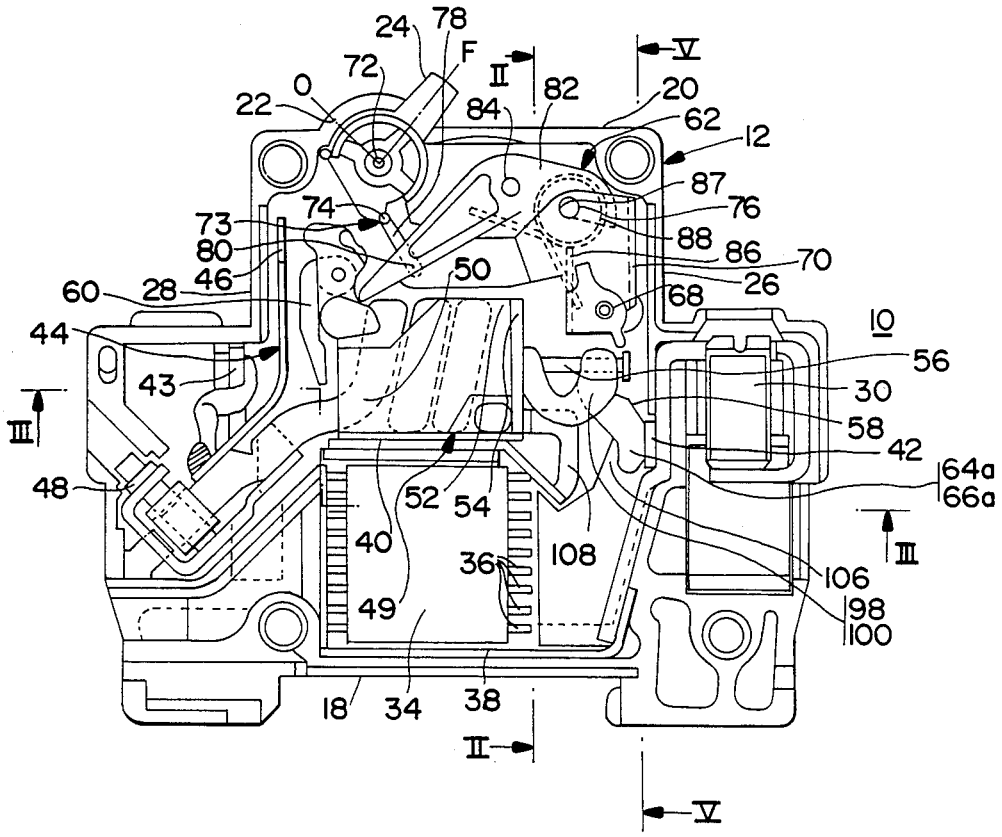
FIG. 1 is an elevational view of the high-rating circuit breaker according to the invention, with one of the faces of the casing removed and the circuit breaker represented in the closed position.

In the figures, a high-rating miniature circuit breaker pole 10 is housed in a casing 12 made of molded insulating material, constituted by assembling two half-shells 14, 16. The casing 12 presents a parallelipipedic structure bounded by a base plate 18 fixing on a support rail (not shown), a front panel 20 fitted with an aperture 22 for a manual control handle 24 to pass through and two narrow opposing side panels 26, 28 in which circuit breaker input and output terminals 30, 32 are housed.

Figure 4:
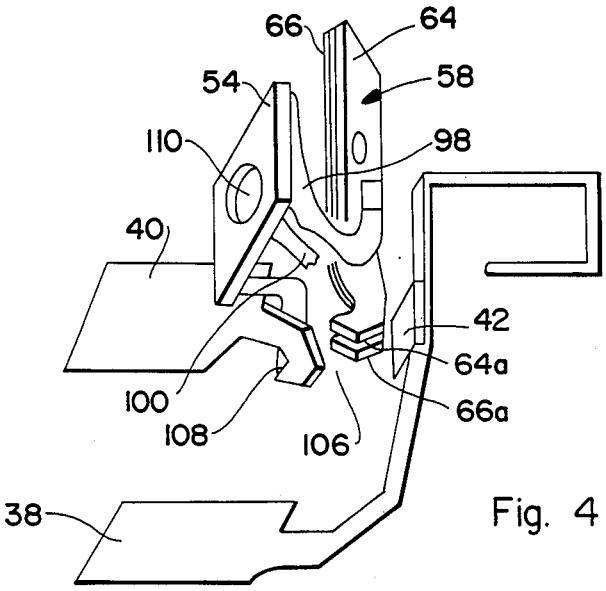
FIG. 4 shows a perspective view of the circuit breaker contact system according to FIG. 1.
Figure 5:
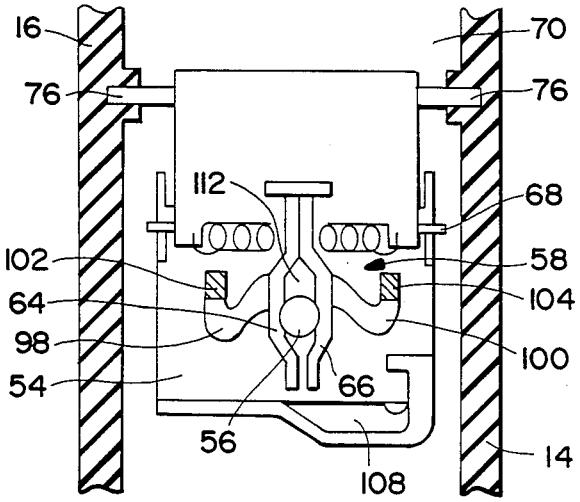
FIG. 5 is a sectional view according to the line V—V of FIG. 1.
Figure 6:
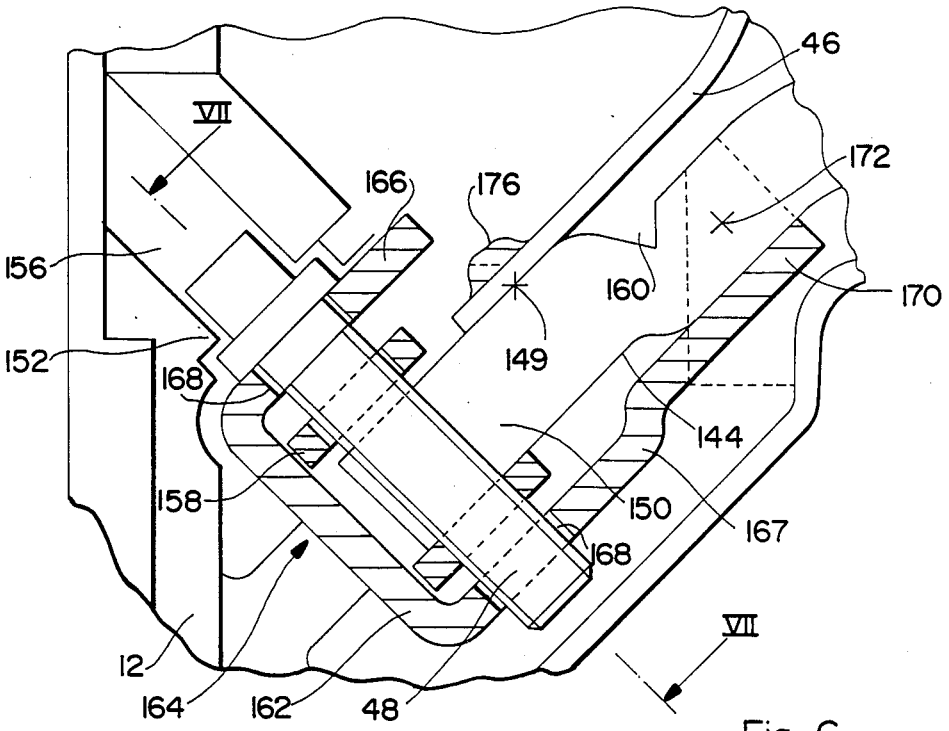
FIG. 6 shows a detailed view of an enlarged scale of the thermomagnetic trip release according to FIG. 1.
Figure 7:
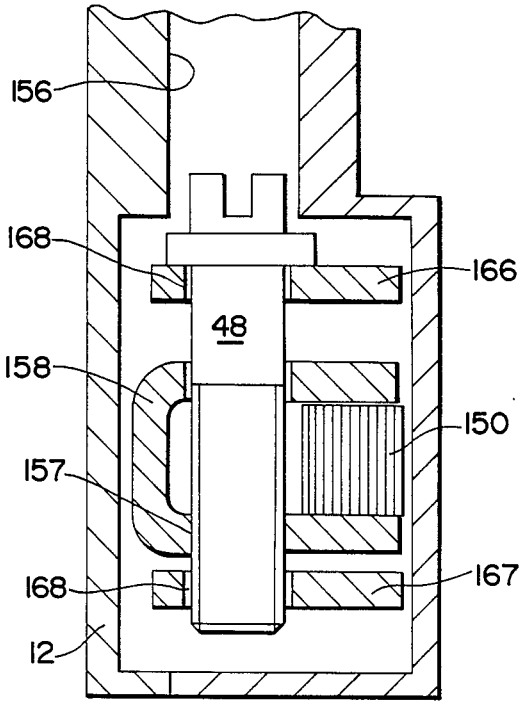
FIG. 7 is a sectional view according to the line VII—VII of FIG. 6.

An arc chute 34 (FIGS. 1 and 3) occupies the whole width of the lower part of the casing 12 and is formed by stacked metal deionization plates 36 extending parallel to the base plate 18. The deionization plates 36 have on each side a pair of electrodes or arcing horns 38, 40, to guide the arc in the contact separation area towards the arc chute 34. The pole input terminal 30 is connected to a stationary contact 42 supported by an extension of the lower arcing horn 38. The output terminal pad 32 is connected by a transverse connecting plate 43 to a thermomagnetic trip release 44 comprising a bimetallic strip thermal tripping device 46 equipped with a deflection adjusting screw 48, and an electromagnetic trip release with an electromagnet 49 controlled by a cylindrical coil 50 located above the arc chute 34. The coil 50 has an axis parallel to the plates 36, and is laterally surrounded by a rectangular cross-sectional metal body 52, formed by assembly of a U-shaped bracket and a cover 54 (FIGS. 1, 4 and 5). The body 52 does not extend over the upper and lower parts of the coil 50, and the two opposing side faces of the U-shaped bracket bear on the internal walls of the half-shells 14, 16 of the casing 12. A plunger core (not shown), mounted with axial sliding inside the coil 50, is fitted with an extractor 56 in the form of a rod, cooperating with a multiple moving contact assembly 58, and also actuates a push-rod acting on a tripping bar 60 of the mechanism. The bimetallic strip 46 also causes the tripping bar to pivot if an overload occurs.

The control mechanism 62 of the circuit breaker 10 is of the kind described in French Pat. No. 2,344,950. The moving contact assembly 58 of each pole comprises a pair of independent contact arms 64, 66, electrically connected in parallel and having contact parts 64 a, 66 a, cooperating with the stationary contact 42 in the closed position in such a way as to form two juxtaposed contact points. The contact arms 64, 66, present an identical structure and extend parallel to one another, being mounted on a common spindle 68 articulated on a branch of an insulating cradle 70. The manual control handle 24 of the mechanism 62 is mounted with limited pivoting on a fixed spindle 72 between a closed position F (shown in FIG. 1) and an open position 0. An internal extension of the handle 24 constitutes a first rod of a toggle-joint 73 with a knee 74.

The cradle 70 is mounted rotatingly on a spindle 76 housed in the aligned bearings of the casing 12 and is coupled to the second rod 78 of the toggle-joint 73 at an articulation point 80 situated on the other branch of the cradle 70 opposite the spindle 68 of the contact arms 64, 66. A tripping hook 82 is pivotally mounted on a parallel fixed spindle 84 and offset in relation to the spindle 76 of the cradle 70. The hook 82 cooperates by means of one of its ends with the tripping bar 60, and by means of its opposite end with a flange 86 supporting the spindle 68, in such a way as to form a latch 87 with the contact arms 64, 66. Pivoting of the tripping bar 60 to the tripped position is operated either by the electromagnetic trip release comprising the coil 50, or by the bimetallic strip 46 to release the hook 82 and the latch 87 with the flange 86 causing movement of the contact arms 64, 66 towards the open position due to the action of an opening spring 88.

A torsion spring 90 (FIG. 2) is threaded on the spindle 68 inside the cradle 70, and comprises an intermediate transverse strand 92 bearing against the flange 86 arranged as a contact support. Each end 94, 96 of the spring 90 is bent into a bracket and latched onto a contact arm 64, 66. The single spring 90 provides in the closed position an independent contact pressure on each contact arm 64, 66 of the moving contact assembly 58.

One of the ends of the coil 50 is connected to the foot of the bimetallic strip 46 on the terminal 32 side, and the other end is connected by soldering to the internal face of the cover 54 of the body 52 of the electromagnetic trip release. The two contact arms 64, 66 are supplied with electrical power by means of two flexible conductors, notably independent copper braids 98, 100, soldered to the external face of the cover 54. The transverse clearance between the fixing points 102, 104 (FIG. 5) of the two braids 98, 100, on the cover 54 is greater than the gap between the contact arms 64, 66. The two fixing points 102, 104 are arranged on either side of the mid-plane of the casing 12, allowing the braids 98, 100 large freedom of movement in two free symmetrical lateral areas, situated between each contact arm 64, 66 and the corresponding half-shell 16, 14.

The upper arcing horn 40 is extended in the direction of the arc formation chamber 106 by an arc puffing loop 108 whose end is secured to the cover 54 by soldering (FIGS. 4 and 5). The loop 108 is fixed and laterally offset in relation to the mid-plane of the casing 12, so as not to hinder movement of the contact arms 64, 66 towards the opening position.

The cover 54 has an orifice 110 drilled in it to support the insulating sheath (not shown) of the coil 50. The moving core of the electromagnetic trip release moves inside the sheath and the rod of the extractor 56 passes axially through the orifice 110 extending in the mid-plane of the casing 12. The extractor 56 is arranged at an intermediate level between the spindle 68 and the contact parts 64 *a*, 66 *a*, and is inserted in an interstice 112 between the two contact arms 64, 66 in such a way as to move the latter simulataneously towards the opening position when tripping occurs on a short-circuit. The coil 50 and the body 52 occupy the whole width of the casing 12.

Operation of the circuit breaker 10 according to the invention is as follows:

A. In the closed position of the circuit breaker 10, represented in FIG. 1, the two contact parts 64 *a*, 66 *a*, simultaneously bear on the stationary contact pad 42 and are held in this position against the force of the spring 88 by the tripping hook 82 locking on the flange 86 and by overshooting the dead-point of the toggle-joint 73. The two independent contact arms 64, 66 are electrically connected in parallel by means of their respective braids 98, 100, in such a way as to constitute two elementary branching circuits, each one having half the rated current intensity of the pole flowing through it. Doubling the contact points on the stationary contact pad 42 reduces the temperature rise by Joule effect and enables high ratings to be used, notably up to 100 Amperes. It is obvious that the moving contact assembly 58 could comprise a plurality of independent contact arms allowing the contact points to be multiplied and the temperature rise to be appreciably reduced. The symmetrical multiple structure of the moving contact assembly 58 also improves balancing of the moving assembly.

Figure 2:
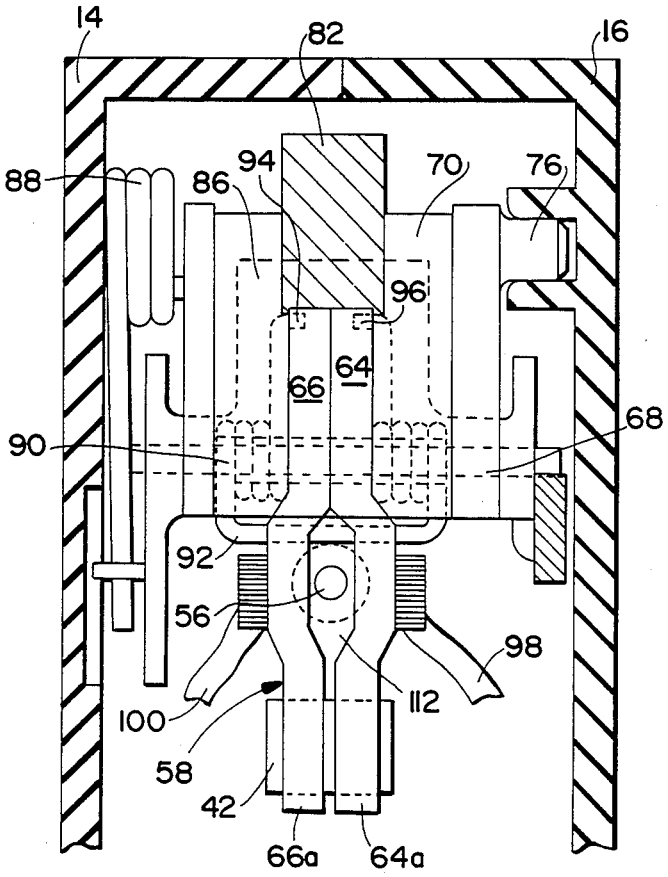

The distribution of the current in the two contact arms 64, 66 of the moving contact assembly 58 according to FIGS. 2 and 5 depends on the impedance of the two branched circuits. In the case of equal impedances, the pole current is divided into two equal elementary currents each having half the nominal intensity of the chosen rating. An impurity being accidentally introduced under a contact part (64 a or 66 a) causes an automatic distribution of the current according to the impedance of the two branched circuits. The distribution of the elementary currents is no longer uniform but the temperature rise nevertheless remains lower than that resulting from using a single contact arm.

It can be noted that the cover 54 of the ferromagnetic body 52, in addition to its function of strengthening the magnetic field, performs various other functions and constitutes:

- a first elecrical connection element between the coil 50 and the two braids 98, 100 of the two contact arms 64, 66;
- a second electrical connection element between the coil 50 and the loop 108 supplying power to the upper arcing horn 40;
- a mechanical means of supporting the insulating sheath of the coil 50 and the moving core and sliding extractor 56 assembly.

The use of the external face of the cover 54 as a means of electrically connecting the two braids 98, 100, enables the independent contact arms 64, 66, to be supplied symmetrically, whatever the point at which the tail of the coil 50 is soldered onto the internal face of the cover 54.

On high-rating circuit breakers (100 Amperes), the cover 54 may be made of a good conducting material, notably copper, without the magnetic tripping threshold being modified. On low-rating circuit breakers (less than 50 Amperes), the cover 54 is part of the ferromagnetic body 52, so as to form a closed magnetic circuit.

B. In the event of automatic tripping on a short-circuit, the electromagnetic trip release extractor 56 acts simultaneously on the two contact arms 64, 66, and causes high-speed separation of the contact parts 64 *a*, 66 *a*, with the stationary contact 42 generating two parallel initial arcs. During opening travel, the contact arms 64, 66 come into the vicinity of the upper arcing horn 40, where arc root migration onto the horn 40 takes place, followed by swift propagation in the direction of the arc chute 34 due to the supply direction of the loop 108.

At the end of opening travel, the contact arms 64, 66 leave the arc formation chamber 106 completely and retract behind the loop 108.

Retraction of the moving contact arms 64, 66 behind the upper arcing horn 40 enables the preassembled stationary contact assembly to be fitted and makes circuit breaker assembly easier.

The arcing horn 40 and its puffing loop 108 can form a single part with the cover 54, that is to say made of steel or copper. The horn 40 is soldered to the cover 54 if the materials used are different.

Figure 3:
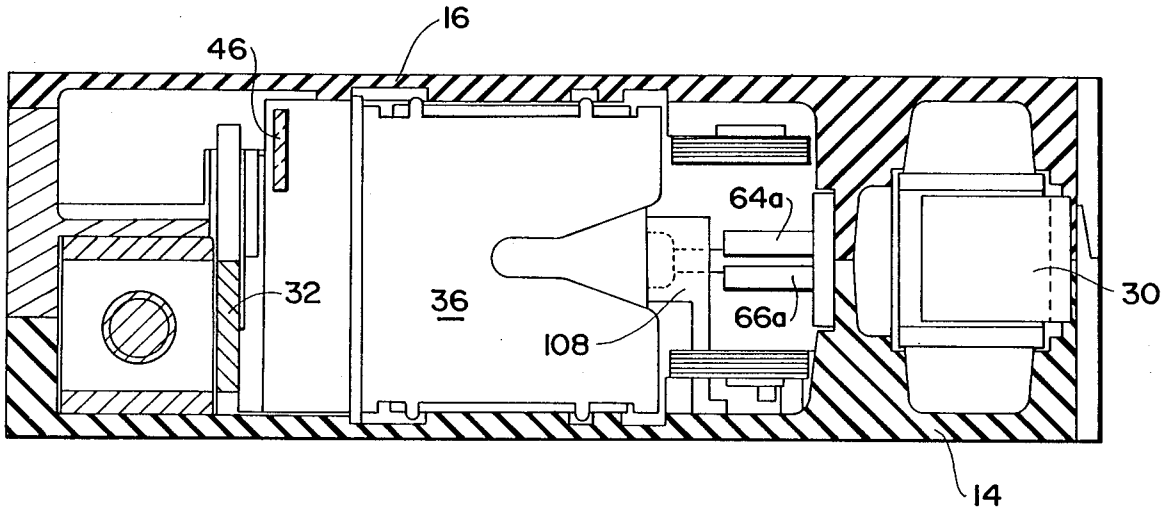
FIG. 3 is a sectional view according to the line III—III of FIG. 1.

FIG. 3 shows the transverse arrangement of the bimetallic strip 46 and of the output terminal 32 offset widthwise in relation to the casing 12, but adopting a coplanar arrangement aligned with the coil 50 would also come within the scope of the invention.

In the embodiment represented in FIGS. 1 to 5, the stationary contact 42 linked with the lower arcing horn 38 comprises a single pad. According to an alternative embodiment, the stationary contact 42 comprises a plurality of elementary pads cooperating with the corresponding contact parts of the moving contact arms.

The coil 50 of the electromagnetic trip release electromagnet 49 in FIG. 1 comprises several joined turns formed after helical winding of a deformable conductor, notably made of copper covered with an insulating coating. The end turn 143, situated ont he tripping bar 60 side, opposite the extractor 56, is extended by a tail 144 acting as a support for the bimetallic strip 46, in the form of an elongated blade. The conductor constituting the turns and the tail 144 has a uniform crosssection designed to give a certain rigidity to the coil 50.

The tail 144 of the coil 50 is appreciably straight, and extends in an oblique direction towards the escape orifice situated at the outlet of the arc chute 34. The foot of the bimetallic strip 46 is fixed by soldering at an intermediate point 149 of a bared part of the tail 144, so as to allow a good heat transfer from the coil 50 to the bimetallic strip 46. Soldering the bimetallic strip 46 directly onto the tail 144 means that a flexible braid providing an electrical connection between coil and bimetallic strip is not necessary, nor is a special metal device to support the bimetallic strip.

The end 150 of the tail 144 cooperates with a thermal tripping threshold adjustment device 152 of the bimetallic strip 46. The adjustment device 152, shown in an inclined orifice 156 of the insulated casing 12, and screwed into a threaded hole 157 of a U-shaped positioning cage 158. The end 150 of the tail 144 is housed in the cage 158 so that screwing the adjusting screw 48 in or out causes a slight deformation of the tail 144, resulting in a relative movement of the free end of the bimetallic strip 46 either towards or away from the tripping bar 60. The tail 144 of the coil 50 advantageously has a notch of reduced cross-section forming a hinge 160, arranged between the junction point 149 of the bimetallic strip 46 and the end turn 143. The tail 144 and adjusting device 152 assembly is supported by a fixed bracket 162 or flange positioned in a compartment 164 of the casing 12. The upper 166 and lower 167 parallel branches of the bracket 162 comprise aligned guiding apertures 168 for the screw 48 to pass through with clearance. The head of the screw 48 bears on the external face of the upper branch 166, whereas the lower branch 167 is prolonged by an extension 170, secured by soldering to the tail 144 in the vicinity of the hinge 160. The latter is advantageously located between the mechanical junction point 172 of the extension 170 with the tail 144, and the positioning cage 158 of the end 150. The screw 48 extends perpendicular to the end 150 of the tail 144.

When the adjusting screw 48 is screwed in or out, the positioning cage 158 moves in alternate translation inside the fixed bracket 162, and causes a slight pivoting of the end 150 of the tail 144 around the hinge 160. The other rigid part of the tail 144 situated between the hinge 160 and the end turn 143 remains stationary during adjustment due to the efficient holding of the extension 170 of the fixing bracket 162.

The bracket 162 and the positioning cage 158 of the end 150 are made of indeformable metal material with a high mechanical resistance, notably of steel, and with a higher electrical resistivity than that of the conductor of the tail 144. A connecting braid 176 is soldered to the foot 148 of the bimetallic strip 46, and is connected to the lug 43 of the connection pad 32. The current flowing through the coil 50 coming from the terminal pad flows thickness-wise through the foot 148 of the bimetallic strip 46. Deflection of the bimetallic strip 46 results essentially from the heat conduction by the tail 144 of the coil 50.

Figure 8:
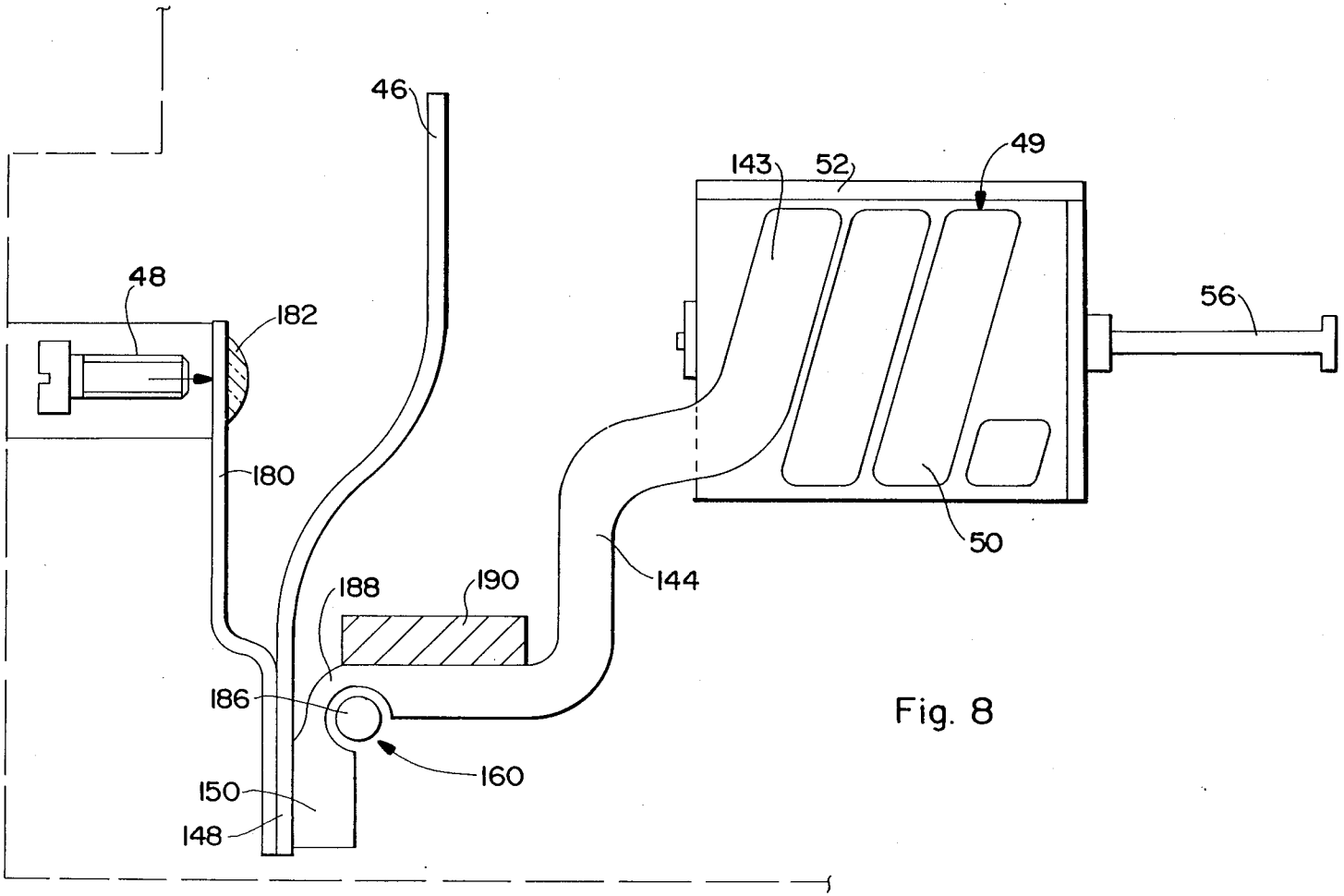
FIGS. 8 to 10 represent schematic views of three alternative embodiments of the thermomagnetic trip release.
Figure 10:
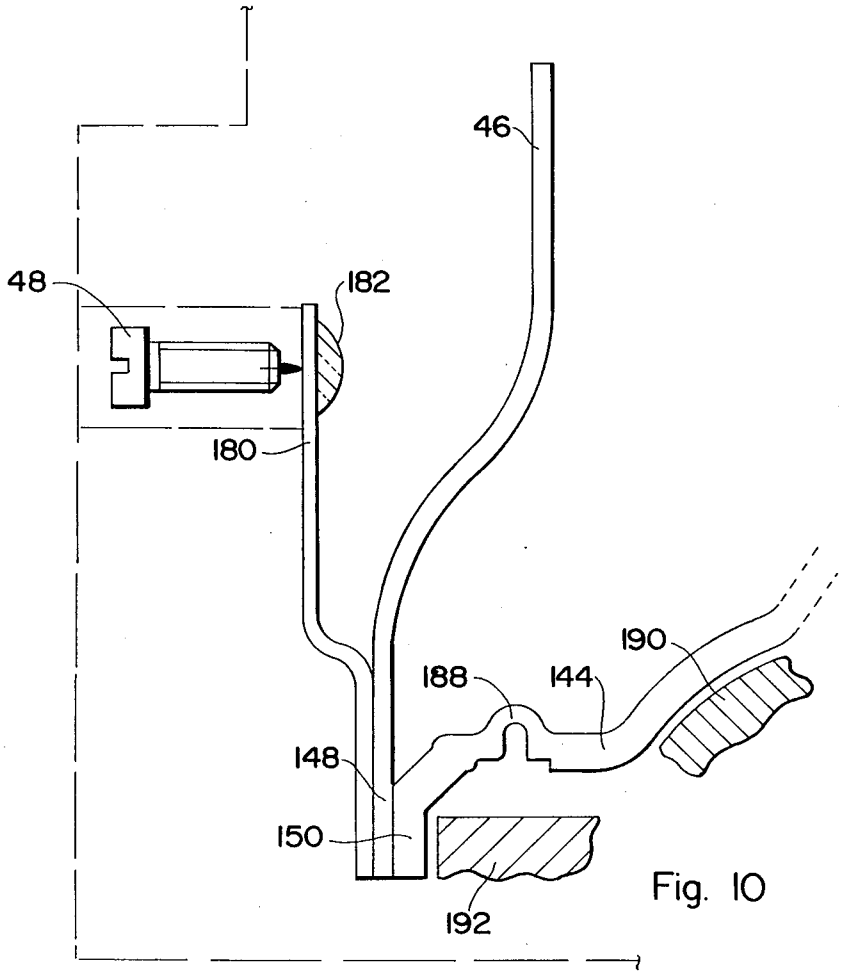
Figure 9:
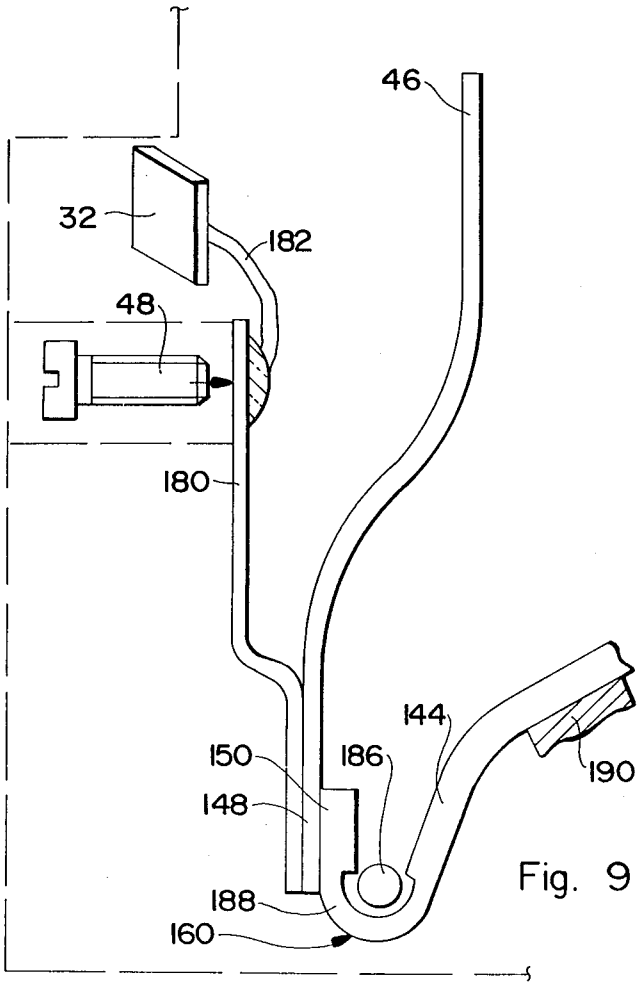

According to the alternative embodiments in FIGS. 8 to 10, the same reference numbers designate identical or similar parts to those in FIG. 1. The end 150 of the tail 144 is soldered directly to one of the sides of the foot 148 of the bimetallic strip 46, whereas a thermal threshold adjusting lever 180 is fixed by soldering to the opposite side of the foot 148. A connecting braid 182 connects the metal lever 180 to a contact pad 32. The pole current flows through the tail 144 of the coil 50 and through the lever 180 after flowing thickness-wise through the foot 148 of the bimetallic strip 46. The current does not flow through the rest of the bimetallic strip 46.The triple soldering at the level of the foot 148 guarantees an excellent coherence between the pole current intensity and the thermal tripping threshold. Deflection of the bimetallic strip 46 results from the heat conduction, following the temperature rise of the coil 50, from the partial direct heating by the current flowing through the foot 148, and from the indirect heating by thermal radiation of the lever 180.

The adjusting lever 180 conducts the current between the foot 148 of the bimetallic strip 46 and the braid 182 connected to the terminal pad 32. The lever 180 acts as heater of the bimetallic strip 46, and the material of the lever 180 is chosen to adjust the indirect heating by radiation. Transmission of the adjustment torque by the lever 180 is performed by the screw 48 which causes a slight pivoting of the foot 148 of the bimetallic strip 46 around the rotation axis of the hinge 160. According to FIGS. 8 and 9, the axis is real and comprises a needle 186 or pivot facing the contracted cross-sectional part 188 of the tail 144. Stops 190 formed by ribs of the insulating casing 12 maintain the tail 144 firmly and prevent any mechanical stresses being transmitted to the body 52 of the coil 50.

According to FIG. 10, the rotation axis of the hinge is fictitious, and is constituted by the protruding edge of a stop 192 bearing on the end 150 of the tail 144. Between the two stops 190, 192, is located the deformable area of contracted cross-sectional part 188, designed to absorb any lateral movement towards the coil 50.

What is claimed is:

1. A low voltage miniature electric circuit breaker with insulated casing equipped with a mechanism controlled by a thermomagnetic trip release, comprising:

a first thermal trip release having a bimetallic strip cooperating with said mechanism when an overload current exceeds a thermal tripping threshold;

a second electromagnetic trip release for protection against short-circuit current, comprising a control coil electromagnet, made up by helical winding of a deformable conductor having a preset rigidity;

an end turn of said coil being extended with the same conductor by a tail cooperating with an adjustment device for the thermal tripping threshold of the first thermal trip release;

said tail being arranged as an adjustable support part of the bimetallic strip which has a foot inserted by soldering between said tail and an adjacent elecrical connection means electrically connected to a contact pad, to cause the current to flow thickness-wise through the foot of the bimetallic strip; and a hinge located along said tail between the foot of the bimetallic strip and the end turn of the coil, to allow relative movement of one part of said tail due to the action of the thermal tripping threshold adjusting device, the other part of the tail connected to the end turn of the coil remaining appreciably stationary.

2. A circuit breaker with a thermomagnetic trip release according to claim 1, wherein the hinge is formed by an area of reduced cross-section allowing mechanical deformation of said tail when a screw of said adjusting device is screwed in or out.

3. A circuit breaker with a thermomagnetic trip release according to claim 2, comprising:

a U-shaped positioning cage having a threaded hole cooperating with said screw of the adjusting device;

the end of said tail being housed within said positioning cage, so that screwing the adjusting screw in or out causes a slight deformation of said tail;

a fixed metal U-shaped bracket located in a compartment of said insulating casing, and arranged to support said tail and the adjusting device, an extension of said bracket acting as support for a part of said tail disposed between said hinge and the end turn of said coil; and a pair of aligned guiding apertures arranged in parallel branches of said bracket, for the screw to pass through with clearance according to a direction perpendicular to the end of said tail.

4. A circuit breaker with a thermomagnetic trip release according to claim 2, wherein the hinge includes an articulation spindle having a needle or pivot cooperating with the reduced cross-section area of the tail.

5. A circuit breaker with a thermomagnetic trip release according to claim 3, wherein the elecrical connection means comprises a conducting braid, and the bracket and positioning cage are made of indeformable metal material having a higher electrical resistance than that of the conductor of the tail.

6. A circuit breaker with a thermomagnetic trip release according to claim 1, wherein the electrical connection means comprises a conducting lever extending in proximity to the bimetallic strip in such a way as to constitute a combined device for indirect heating, by radiation of the bimetallic strip, and for transmission of the thermal threshold adjustment torque.

7. A low voltage miniature electric circuit breaker with a parallelipipedic molded insulated casing, each pole of the circuit breaker comprising:

an opening and closing mechanism occupying almost the whole width of the casing and controlled either by a thermomagnetic trip release ensuring automatic tripping in the event of a short-circuit or overload, or by a manual control handle, the trip release comprising a bimetallic strip and an electromagnet with a coil and sliding plunger core;

a pair of pole connection terminals;

a stationary contact assembly electrically connected to one of the terminals;

a moving contact assembly mechanically coupled to the mechanism for actuation between an open position and a closed position and electrically connected to the other terminal via the coil;

an extractor rod securely fixed to the moving core of the electromagnet and shifting the moving contact assembly at high speed to the opening position when tripping occurs on a short-circuit;

an arc chute formed by stacking of metal deionization plates, the trip release electromagnet being located between the arc chute and the mechanism depthwise in the casing;

a pair of arc guiding electrodes or horns on which the arc strikes after separation of the contacts;

a common transverse spindle articulated on a cradle of said mechanism;

a plurality of identical independent contact arms of said moving contact assembly being mounted at regular intervals on said spindle within said pole, each moving contact arm comprising a contact part and a braid for electrical connection with the coil;

said assembly having a symmetrical multiple structure with several branched elementary circuits, each having a fraction of the pole rated current flowing through it resulting in the contact points with the stationary contact assembly being multiplied; and the extractor of the electromagnet extending in the mid-plane of the casing to act simultaneously on all the independent contact arms when a shortcircuit occurs, with the formation of several parallel elementary arcs at the beginning of opening travel of the contacts.

8. A circuit breaker according to claim 7, further comprising an upper arcing horn, located between the arc chute and the electromagnet, so as to extend in the direction of the arc chute by a puffing loop laterally offset in relation to the mid-plane of the casing, wherein the contact arms of the moving contact assembly retract behind the upper arcing horn at the end of opening travel.

9. A circuit breaker according to claim 7, further comprising a metal body framing the coil of the electromagnet, one end of the coil is fixed by soldering to the internal wall of the body, and the external wall of the body acts as electrical connection means of the flexible braids associated with the independent contact arms, the assembly being arranged to ensure a symmetrical supply to said contact arms, whatever the point at which the end of the coil is soldered.

10. A circuit breaker according to claim 9, wherein the metal body of the electromagnet is of rectangular cross-section, and includes:

a U-shaped bracket assembly, with two opposing lateral faces which bear on the internal walls of the half-shells of the casing; and a cover situated between a front face of the coil and the moving contact assembly and having an orifice through which the extractor passes axially, the cover of the body acting as a bilateral electrical connection means of the end of the coil, the braids and the puffing loop.

11. A circuit breaker according to claim 7, wherein the moving contact assembly comprises two contact arms symmetrical with respect to a mid-plane and cooperating with a torsion spring threaded on the spindle inside said cradle, the spring being disposed so as to ensure an independent contact pressure on each contact arm in the closed position.

12. A circuit breaker according to claim 10, wherein the upper arcing horn forms a single part with the cover made of a good conducting material, notably copper, the rest of the ferromagnetic body being made of steel.

13. A circuit breaker according to claim 11, wherein the contact parts of the two independent contact arms bear on a stationary contact formed by a single pad soldered to an extension of the lower arcing horn, the bimetallic strip of the trip release and the pole output terminal being disposed on either side of the mid-plane of the insulated casing.

* * * * *